United States Patent [19]

Brotschi

[11] Patent Number: 4,785,498

[45] Date of Patent: Nov. 22, 1988

[54] DOOR AND WINDOW HINGE WHICH IS ADJUSTABLE DURING AND AFTER INSTALLATION

[75] Inventor: Othmar Brotschi, Grenchen, Switzerland

[73] Assignee: Gebr. Brotschi & Co. AG, Grenchen, Switzerland

[21] Appl. No.: 935,649

[22] Filed: Nov. 26, 1986

Related U.S. Application Data

[63] Continuation of Ser. No. 692,633, Jan. 18, 1985, abandoned.

[30] Foreign Application Priority Data

Jan. 24, 1984 [CH] Switzerland ..... 292/84

[51] Int. Cl.[4] ..... E05D 7/02; E05D 7/04

[52] U.S. Cl. ..... 16/238; 16/240; 16/243; 16/246; 16/382; 16/DIG. 39; 16/DIG. 43

[58] Field of Search ..... 16/235, 236, 238, 240, 16/241, 244, 245, 246, 282, 283, 381, 382, DIG. 39, DIG. 40, DIG. 43, 243

[56] References Cited

U.S. PATENT DOCUMENTS

| | | | |
|---|---|---|---|
| 310,033 | 12/1884 | Collamore | 16/246 |
| 1,019,184 | 3/1912 | Peterson | 16/246 |
| 2,618,010 | 4/1952 | Helz | 16/244 |
| 3,007,193 | 11/1961 | Hughes et al. | 16/244 |

FOREIGN PATENT DOCUMENTS

| | | | |
|---|---|---|---|
| 87157 | 7/1959 | Denmark | 16/243 |
| 2220478 | 11/1973 | Fed. Rep. of Germany | 16/243 |
| 777724 | 2/1935 | France | 16/243 |
| 1007855 | 5/1952 | France | 16/244 |
| 1340690 | 9/1963 | France | 16/235 |
| 737344 | 9/1955 | United Kingdom | 16/235 |
| 1060510 | 3/1967 | United Kingdom | 16/381 |
| 2069592 | 8/1981 | United Kingdom | 16/246 |
| 2084240 | 4/1982 | United Kingdom | 16/235 |

*Primary Examiner*—Frank T. Yost
*Assistant Examiner*—Hien H. Phan
*Attorney, Agent, or Firm*—Walter C. Farley

[57] ABSTRACT

A universal hinge structure includes a hinge part attachable to a frame and another hinge part attachable to a pivotable closure which is to be mounted in the frame. At least one of the hinge parts includes a cylindrical body having an adjustment screw extending therethrough and protruding into either the frame or the closure member. The adjustment screw is restrained by a locking pin so that it can not move axially relative to the body. The adjustment screws is threaded so that rotation of the screw in the frame or movable member adjusts the pivot axis of the hinge structure relative to the frame. Embodiments for various frame and closure member materials are disclosed.

12 Claims, 5 Drawing Sheets

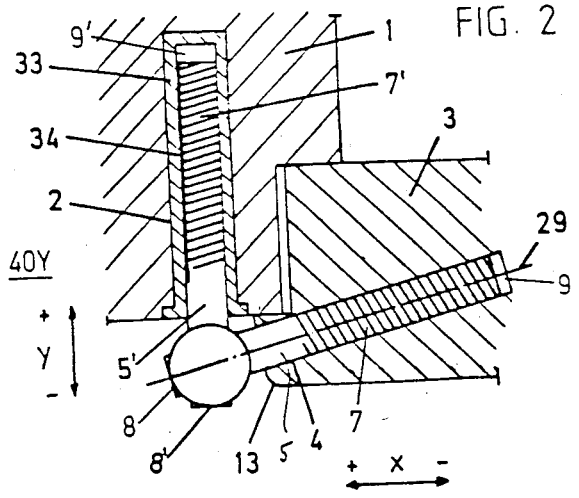
FIG. 2
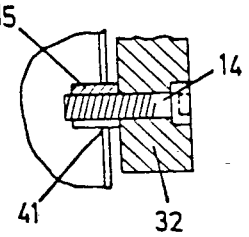
FIG. 3
FIG. 3A
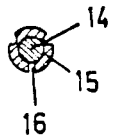
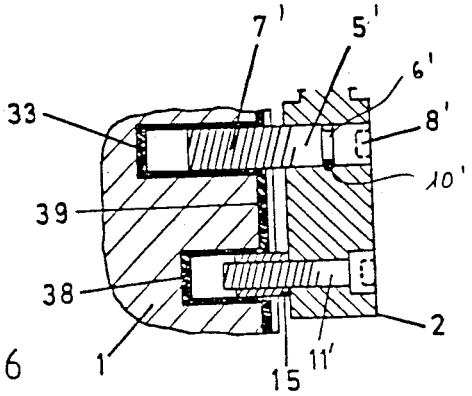
FIG. 6

DOOR AND WINDOW HINGE WHICH IS ADJUSTABLE DURING AND AFTER INSTALLATION

This is a continuation of Ser. No. 692,633 filed Jan. 18, 1985, now abandoned.

The present invention relates to an adjusting device on a door and window hinge which is adjustable during and after fitting, the hinge having a frame part and a leaf or casement part for pivotably attaching a leaf or casement to a frame.

BACKGROUND OF THE INVENTION

Numerous adjustable hinges are known which all suffer from significant advantages and which can only be used in a limited manner, e.g. only for certain types of doors or windows. These known hinges often comprise several components and are complicated and therefore expensive, while being difficult to adjust. An example thereof is the GEHO adjusting hinge available in hardware stores. It comprises several complicated, expensive parts, including castings, and it restricted to use on wooden windows with an envelope. In addition, different hinges are required for casements opening to the left on the one hand and opening to the right on the other. In order to be able to fit the GEHO hinge (and many other hinges), it is necessary to form a recess in the frame or casement, which is accompanied by the risk of breaks on the visible surface. Thus, the hitherto known hinges are not only expensive to manufacture, but require considerable effort and expenditure during fitting. Moreover, they are often only suitable for adjustment in one direction, while it is often necessary to carry out an adjustment in three dimensions in space.

SUMMARY OF THE INVENTION

Accordingly, an object of the invention is to provide a hinge for both doors and windows which can be universally used for such movable closures installed for right or left operation, and is suitable for all types of materials and sections (wood, steel, aluminum, plastic) which are hollow or backfilled. It must be simple, rational and therefore inexpensive to manufacture. It must also be simple to fit and require a minimum of work on the frame and casement or leaf so as to reduce risk of damage. It must permit easy adjustment and random readjustment using simple tools and also by unskilled persons.

Thus, an objective of the present invention is to fulfill these requirements as completely as possible with a simple and universally usable door and window hinge, while obviating the disadvantages of the known, aforementioned constructions.

Briefly described, the invention includes an adjustable hinge for pivotally supporting a movable closure on a frame such that the pivot axis for the movable closure member is adjustable relative to the frame during and after installation including a first hinge element having a first hinge body with a central axis and an upwardly extending pin coaxial with the axis. First means is provided for attaching the body to the frame. A second hinge element includes a second hinge body rotatably and coaxially supported on the pin so that the hinge bodies have a common central axis. Second means is provided for attaching the second body to the movable closure member. At least one of the first and second means for attaching includes an adjustment bolt extending rotatably through its associated hinge body, the adjustment bolt having a threaded end portion extending into either the frame or the movable member which has means defining threads to engage the bolt. The bolt is restrained against axial movement in either direction relative to the hinge body so that when the bolt is turned the axis of the hinge elements is moved toward or away from the frame or movable member. A guide bolt is carried by the hinge body and extends, parallel with the adjustment bolt, into the frame or movable member to prevent the hinge from rotating when the adjustment bolt is turned. The other means for attaching also has an arrangement for adjusting the axis relative to the other one of the movable closure member or frame.

Various embodiments of the invention are described hereinafter relative to the drawings, wherein:

FIG. 2 is a top plan view, in section, of the embodiment of FIG. 1 with an inserted threaded sleeve;

FIG. 3 is an embodiment of a guide member with a lead screw and an expanding sleeve shown in a frame similar to FIG. 1B;

FIG. 3A is a cross-section through a part of FIG. 3;

FIG. 6 is a partial side elevation, in section, of an embodiment with sleeves and a web.

DESCRIPTION OF PREFERRED EMBODIMENTS

Figure 1:
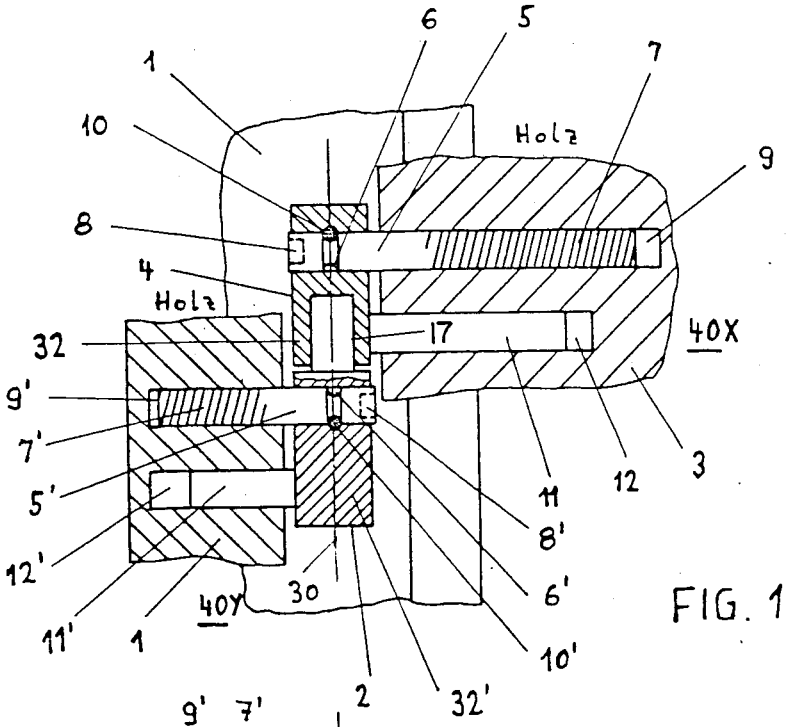
FIG. 1 is a side elevation, in section, of an embodiment adjustable in two directions for use with a door openable 90° and with a wooden frame part.
Figure 1A:
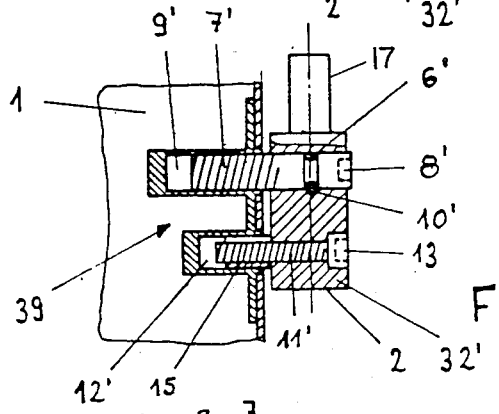
FIG. 1A is a partial side elevation, in section, of a hinge upper portion mounted on a steel frame corresponding to the upper portion of FIG. 1.
Figure 1B:
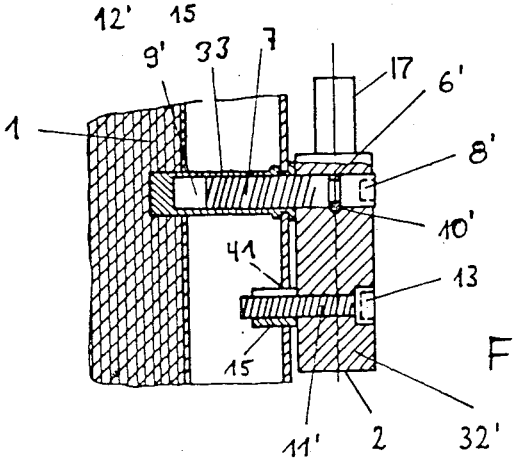
FIG. 1B is a view similar to FIG. 1A of a hinge lower portion mounted on a hollow section and usable with the upper portion of the FIG. 1.
Figure 1C:
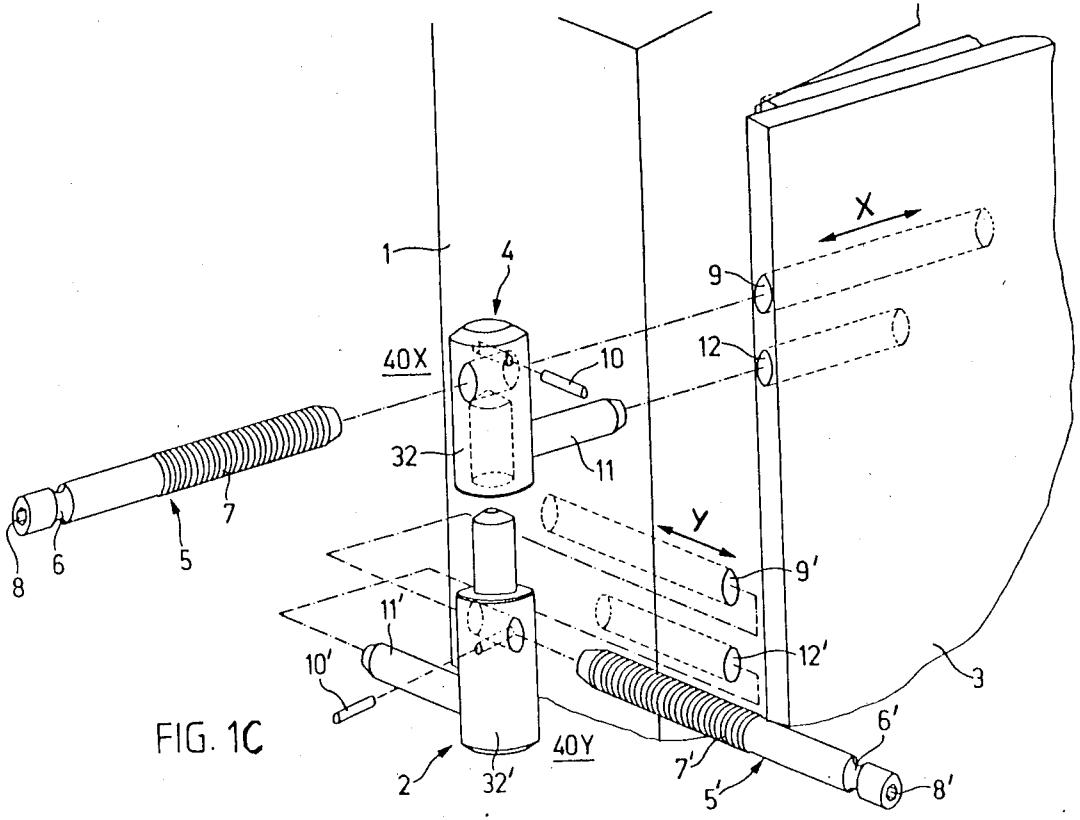
FIG. 1C is an exploded perspective view of an embodiment of a hinge according to FIG. 1.

FIGS. 1, 1C and 2 show a door and window hinge adjustable in two nearly orthogonal directions X and Y in space and having two corresponding lateral adjustment means 40X, 40Y, adjustment means 40X including a second hinge element 4 attached to a movable door or window unit 3 and means 40Y including a first hinge element 2 attached to a fixed frame 1. Each of the lateral adjustment means has a threaded bolt 5, 5', which are rotatably held in hinge members 32, 32', respectively, by pins 10, 10' lying in circular grooves 6, 6', which act as safety elements, cut into the threaded bolts. Pins 10, 10' are fixed in the hinge member 32, 32' and consequently prevent axial displacement of the threaded bolts 5, 5' relative to hinge member 32, 32' in directions +X and −X or +Y and −Y when one or other of the threaded bolts 5, 5' is turned. Threaded bolt 5 has a hexagonal end recess 8 to receive a tool so that the bolt can be rotated about its longitudinal axis, moving the movable member 3 in direction X by the action of adjusting thread 7. Threaded bolt 5 is located in a threaded hole 9 of the door or window unit 3. A guide bolt 11 protrudes from hinge member 32 and extends into a guide hole 12 to prevent any twisting of the lateral adjustment means around the axis of bolt 5. The foregoing description also applies to first hinge element 2, if it is also constructed in an adjustable manner. In connection with the above FIGS. 1, 1A and 1B show embodiments of the lower portions of the hinge for wooden, steel and hollow section frames, respectively, all three lower portions being usable with the same upper portion, which is shown mounted in a wooden door or window unit.

The second lateral adjustment means 40X includes a second hinge element 4, the first lateral adjustment means 40Y having a first hinge elements 2, the latter moving the pivot axis of the movable closure member 3 relative to the frame in direction Y (FIG. 2). A threaded sleeve 33 is used as the threaded hole 9' and can be adapted to various frame materials such as a frame section with backfilling. An important advantage of the simple hinge according to the invention is that, as is apparent from the examples of the further drawings, satisfactory mounting for all types of materials and profiles can be achieved in the sense of a building block system by variously constructed thread counterparts 9, 9' or guide bolts 11, 11' and guide holes 12, 12' (cf FIGS. 1, 1A, 1B).

However, it is also necessary to secure the hinge in a simple manner so that once the hinge has been fitted and set with a hung-on movable casement or leaf, this setting remains fixed and will not be subsequently unintentionally detachable or adjustable. However, if desired, the setting must be such that it can be removed and reset. The way in which this fixing can be achieved in a very simple manner will be explained with respect to the lateral adjustment means 40 of FIGS. 1 or 2 in a wooden movable closure 3 which in FIG. 2 has an outline 13. The threaded hole 9 and the guide hole 12 are made in this embodiment from the actual casement or leaf material, i.e., wood, and are placed directly therein as holes. Using a simple jig, a hole with the core diameter is made at the top and an identical hole is made at the bottom as guide holes. Threaded bolt 5 having an adjusting thread 7 and the guide bolt 11 are then driven into the two holes. The last 5 to 10 mm are set to the desired depth by rotating threaded bolt 5, which is an adjusting screw. The adjusting thread 7 forms a self-locking fit. If the adjusting screw has been screwed too far into hole 9, then by rotating the screw in the opposite direction, the hinge member 32 can be extracted to the correct depth. In the case of windows and doors which are not made from wood, it is possible to provide other fixing means. The cylindrical member 5 can either be directly fixed or an indirect fixing can be achieved, in that the guide member 11 is constructed as a fixable lead screw 14 with an expanding sleeve 15 and the guide opening part 10 constitutes a guide hole 41, as shown in FIG. 3. Expanding sleeve 15 is displaceably positioned in the guide hole. When lead screw 14 is tightened, the expanding sleeve 15 is drawn against the hinge member 32, so that the slot 16 made therein is expanded and the expanding sleeve is pressed against the guide hole 41 of the surrounding profile and is consequently fixed. This is shown in longitudinal section in FIG. 3 and in cross-section in FIG. 3A.

Direct attachment can also be achieved by providing a locking coating 34 on threaded bolt 5 (FIG. 2, part 40Y, FIG. 5A, part 40Z), with a material such as Tuflok, Loctite or Teflon. Alternatively, either the adjusting thread 7 an be constructed in self-locking manner in the thread counterpart 9 or the pin 10 can be so rigidly seated in annular groove 6 that the cylindrical member 5 can be selectively adjusted by means of a simple tool by overcoming the static friction, but cannot be unintentionally turned out of its position because of vibrations or the swinging movements of the casement or leaf.

A decisive advantage of the hinge according to the invention is that its lateral adjustment means 40X, 40Y is constructed symmetrically with respect to its sectional plane 29 (FIG. 2) or 30 (FIG. 1) and can consequently be used for casements or leaves having pivot axes at the left or right, i.e., the same embodiment can be used in either case.

Figure 4:
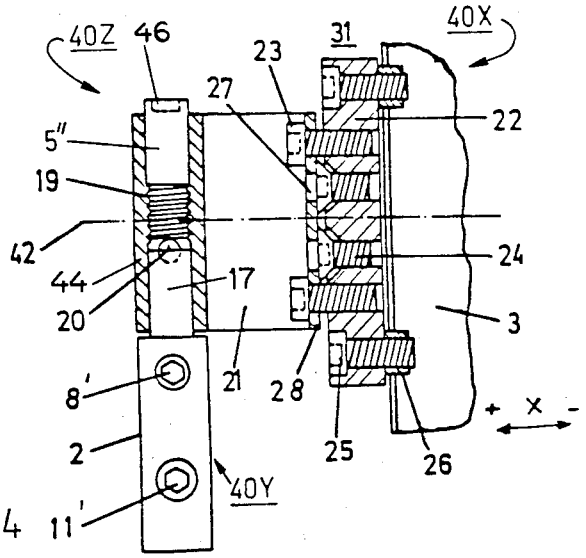
FIG. 4 is a side elevation, in section, of an embodiment adjustable in three directions, with a vertical adjustment means and a block adjustment means associated with the movable closure member.
Figure 4A:
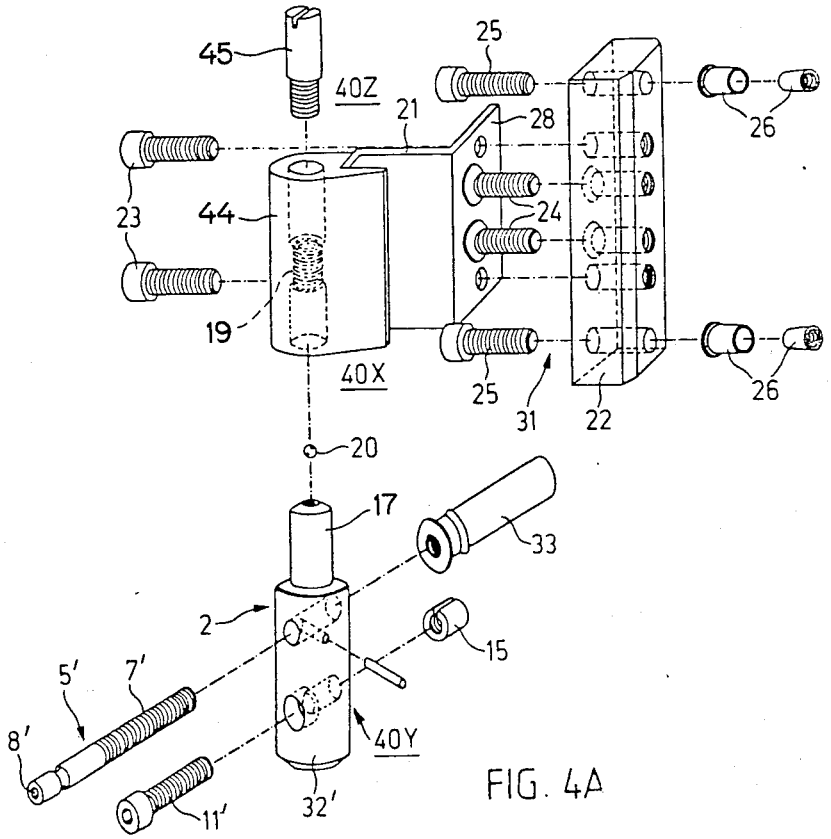
FIG. 4A is an exploded perspective view of an embodiment according to FIG. 4A with the block adjustment means.

The same also applies to the vertical adjustment means 40Z in the embodiments shown in FIGS. 4 and 4A, shown combined with a block adjustment means 31 with angle plates 21, which are symmetrically constructed with respect to their sectional plane 42. The vertical adjustment means 40Z comprises a threaded bolt 45 constructed as a grub or set screw which threadedly engages an internal thread 19 in hinge part 44. A ball 20 which is preferable hardened rests in a recess in the upper end of pin 17 of hinge element 2, the flat end of the grub screw rotatably resting on the ball. Thread 19, which functions in conjunction with screw 45 as a safety element to prevent undesired axial displacement and also as a hold back means is provided in the center of the angle plate 21 so that the latter is vertically symmetrical with respect to sectional plane 42. Plate 21 together with the block adjustment means 31 fixed thereto can also be mounted in reverse manner and can consequently be used for leaves or casements opening to the right or left. The same also applies to the embodiment of FIG. 5A, the symmetrical hinge member 32, thread 19 and elements in the sectional plane 42 or 42'.

Further details will now be given of the block adjustment means. The aforementioned angle plate 21 ends in a bent plate 28 which forms the block adjustment means 31 together with a block 22, lock bolts 23, adjusting screws 24, block screws 25, threaded sleeves 26 and adjustment openings 27. Any desired adjustment position is set by adjusting screws 24, followed by the tightening of the lock bolts 23, so that the setting is fixed. By means of block screws 25 and threaded sleeves 26, the block is fitted to a metal profile of a movable door or window 3. It is often advantageous to use blind rivet nuts as threaded sleeves 26, which are merely inserted in profile holes and can be fixed with the associated tool.

Figure 5:
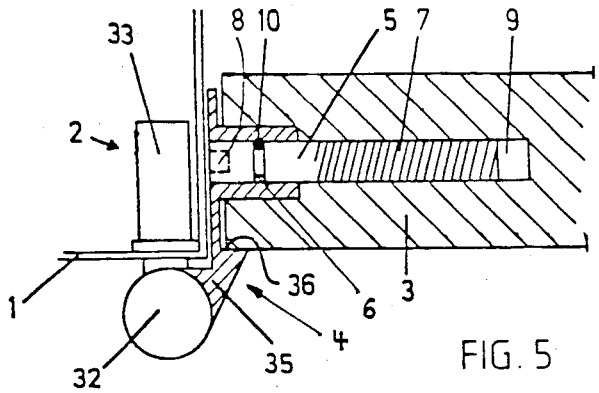
FIG. 5 is a top plan view in section, of an embodiment with a butt mounted adjusting hinge and a flange for covering the joint gap.
Figure 5A:
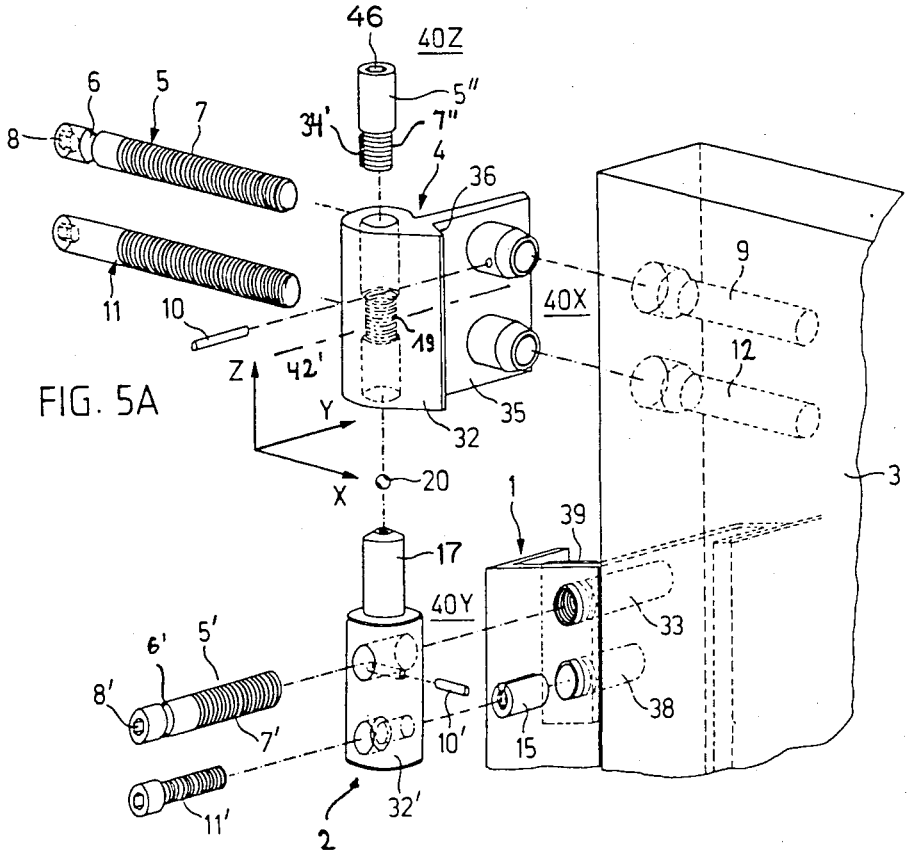
FIG. 5A is an exploded perspective view of the embodiment according to FIG. 5 which is adjustable in three directions.

Obviously, the block adjustment means 31 of FIGS. 4 and 4A could be replaced by a lateral adjustment means 40X according to the embodiments of FIGS. 1C and 5A, in which case two lateral adjustment means 40X and 40Y would be combined with the vertical adjustment means 40Z. For butt mounted members in the manner shown in FIG. 5, the hinge member 32 of FIG. 1 is effectively extended by a plate 35 on which are mounted cylindrical member 5, pin 10 and guide member 11. As has already been stated, the hinge member 32 can also be supplemented by a vertical adjustment means 40Z, plate 35 of FIGS. 5 and 5A then corresponding to angle plate 21 of FIGS. 4 and 4A. In FIGS. 5 and 5A, the frame part 2, which is shown attached to a sheet metal frame or the like 1, has a threaded sleeve 33. As a function of the frame or casement/leaf material, the thread counterpart 9 is preferably also constructed as a threaded sleeve 33, which can assume various forms. Thus, in FIG. 2, it is inserted as a threaded sleeve in a solid frame, whereas in FIG. 1B it is inserted as an upset or blind rivet sleeve in a hollow wall and in FIGS. 1A or 5A as a sleeve for welding to a steel frame.

When the hinge is adjusted according to the embodiments shown in FIGS. 5 and 5A, an unattractive gap is formed between the edge of movable closure 3 and hinge member 32 or the plate 35 of the lateral adjustment means 40. This gap can be covered by providing a projection 36 on plate 35.

Finally, FIGS. 1A and 6 show a further advantageous embodiment of the thread counterpart to receive a threaded bolt and guide hole for sections which are backfilled. This embodiment is also shown on the first hinge element 2 of FIG. 5A. Counterpart 9 is constructed as a threaded sleeve 33 and the guide hole 12 as a guide sleeve 38, the sleeves 37, 38 being connected by means of web 39 to a workpiece, which can be spot-welded to a steel section frame. However, it can also be inserted in plastic profiles and backfilled. The guide member here is constructed as in FIG. 3 as a guide bolt 11' with an expansion sleeve 15. It is particularly advantageous in connection with the hinges according to the invention for all the screw heads of the adjustment means 40X, 40Y, 40Z and 31, including the ends 8, 8' of the rotatable threaded adjustment bolts to be constructed in the same way, preferably with a hexagonal recess. For adjustment purposes, it is then merely necessary to have an easily operated, bent socket screw wrench with very good accessibility. It is naturally possible to use other rotating adjustment tools, such as recessed squares, slotted or cross-head screws.

As a result of the simple, universal construction according to the invention, the aforementioned high requirements can be fulfilled.

I claim:

1. An adjustable hinge for pivotably supporting a movable closure on a frame such that the pivot axis of the closure member is adjustable relative to the frame during and after installation, comprising the combination of a first hinge element including a first hinge body having a central axis with an axially extending pin coaxial with said central axis and first means for attaching said first hinge body to the frame; and a second hinge element including a second hinge body having an axial passage extending therethrough for receiving said pin in one end thereof so that said second hinge body is rotatably and coaxially supported on said axially extending pin and so that said hinge bodies have a common central axis and second means for attaching said second hinge body to the movable closure member, said axial passage having means defining internal threads extending substantially symmetrically on opposite sides of a central transverse plane perpendicular to said central axis;

an externally threaded support bolt extending into the opposite end of said axial passage from said pin;

a ball between the inner ends of said pin and said threaded support bolt so that said hinge elements are relatively pivotable about said central axis and are relatively axially adjustable by rotation of said support bolt, said support bolt being selectively threadable into either end of said axial passage so that said first hinge element can be mounted on either side of a frame with said support bolt above said pin;

one of said first and second means for attaching including an adjustment bolt extending rotatably completely through one of said first and second hinge bodies, said adjustment bolt having a threaded end portion extending into the associated one of said frame and said movable closure member, means defining threads in said one of said frame and movable closure member for threadedly engaging said adjustment bolt, means for restraining said adjustment bolt against axial movement in either direction relative to said one of said first and second hinge bodies so that rotation of said adjustment bolt about its longitudinal axis moves said central axis of said hinge elements toward or away from said one of said frame and said movable closure member, and guide bolt means carried by said one of said first and second hinge bodies and extending parallel with said adjustment bolt and being slidable into said one of said frame and said movable closure member for preventing rotation of said one of said first and second hinge bodies about said longitudinal axis of said adjustment bolt when said adjustment bolt is rotated, the other of said first and second means for attaching including means for adjusting the location of said central axis of said hinge elements relative to the other of said frame and said movable closure member.

2. An adjustable hinge according to claim 1 wherein said means for axially restraining said adjustment bolt includes an annular recess in said adjustment bolt within the hinge body through which said adjustment bolt extends, and a locking pin extending into said hinge body generally perpendicular to said adjustment bolt and lying in said annular recess.

3. An adjustable hinge according to claim 2 wherein said first hinge body is generally cylindrical and said adjustment bolt and said guide bolt means pass through said central axis of said body.

4. An adjustable hinge according to claim 1 wherein the other of said first and second means for attaching includes a bracket attached to the other hinge body, said bracket having a plurality of openings therethrough first threaded means extending into and threadedly engaging the associated one of said frame and said movable closure member, said first threaded means passing through at least one of said openings in said bracket and having an enlargement for urging said bracket toward said associated one of said frame and said movable closure member; and second threaded means extending into and threadedly engaging the associated one of said frame and said movable closure member, said second threaded means abutting said bracket to limit the motion of said bracket toward the associated one of said frame and said movable closure member.

5. An adjustable hinge according to claim 4 and further including an internally threaded sleeve extending into said one of said frame and said movable closure member for receiving said theaded end portion of said adjustment bolt.

6. An adjustable hinge according to claim 5 wherein said adjustment bolt includes an outer exposed end having a non-circular recess for receiving an adjustment tool.

7. An adjustable hinge for pivotably supporting a movable closure on a frame such that the pivot axis of the hinge is adjustable relative to at least one of the closure and frame during and after installation comprising the combination of a first hinge element including a first hinge body having a central axis, an axially extending pin coaxial with said central axis and first means for attaching said first hinge body to the frame;

a second hinge element including a second hinge body having an axial passage extending through said second hinge body for receiving said axially extending pin in one end thereof so that said hinge bodies have a common central axis, second means for attaching said second hinge body to the movable closure member, and means in said axial passage defining internal threads extending substantially equal distances in both directions axially away from a central transverse plane perpendicular to said central axis;

an externally threaded support bolt extending into the opposite end of said axial passage from said pin and threadedly engaging said internal threads, said support bolt being selectively threadable into either end of said axial passage so that said first hinge element can be mounted on either side of a frame with said support bolt above said pin;

a friction-reducing ball between the inner, distal ends of said pin and said threaded support bolt so that said second hinge body is rotatably supported through said support bolt on said pin, the axial position of said second hinge body relative to said first hinge body being adjustable by rotation of said support bolt to adjust the axial position thereof in said axial passage; and at least one of said first and second means for attaching including adjustable means for changing the distance between said central axis of the respective one of said first and second hinge elements and one of said frame and said closure member.

8. An adjustable hinge according to claim 7 wherein said adjustable means for changing the distance comprises an adjustment block;

block screws for attaching said adjustment block to one of said frame and said closure member;

a hinge plate fixedly attached to one of said first and second hinge bodies and having first and second surfaces generally parallel with said adjustment block adjustment screws threadedly engaging said adjustment block and abutting said first surface of said hinge plate facing said block for establishing a distance between said first surface and said block;

locking screws extending through said plate and threadedly engaging said block, said locking screws having enlarged heads for engaging the second surface of said plate and holding said plate against said adjustment screws; and means defining openings through said plate to permit access to said adjustment screws for adjustment thereof.

9. An adjustable hinge according to claim 8 wherein said adjustable means including said hinge plate and block is formed symmetrically with respect to said central transverse plane.

10. An adjustable hinge according to claim 9 and further including internally threaded sleeves mounted in said one of said frame and said closure member for receiving said block screws, said sleeves being formed as blind rivets.

11. An adjustable hinge according to claim 10 wherein all of said screws are formed with heads to receive the same adjusting tool.

12. An adjustable hinge according to claim 11 wherein said heads of said screws for formed with hexagonal sockets.

* * * * *